US008462142B2

(12) United States Patent
Choe et al.

(10) Patent No.: US 8,462,142 B2
(45) Date of Patent: Jun. 11, 2013

(54) DATA DRIVING APPARATUS AND DISPLAY DEVICE USING THE SAME

(75) Inventors: Weon-Jun Choe, Seoul (KR); Ah-Reum Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 723 days.

(21) Appl. No.: 12/628,333

(22) Filed: Dec. 1, 2009

(65) Prior Publication Data

US 2010/0146175 A1 Jun. 10, 2010

(30) Foreign Application Priority Data

Dec. 8, 2008 (KR) ..... 10-2008-0124035

(51) Int. Cl.
*G09G 5/00* (2006.01)
*G09G 3/20* (2006.01)
*G09G 3/36* (2006.01)

(52) U.S. Cl.
USPC ..... 345/204; 345/55; 345/98

(58) Field of Classification Search
None
See application file for complete search history.

(56) References Cited

U.S. PATENT DOCUMENTS 5,021,775 A * 6/1991 Babin ..... 345/213
2001/0022571 A1* 9/2001 Nakano et al. ..... 345/98
2004/0227744 A1* 11/2004 Toriumi et al. ..... 345/204

* cited by examiner

*Primary Examiner* — Andrew L Sniezek
(74) *Attorney, Agent, or Firm* — Cantor Colburn LLP

(57) ABSTRACT

A display device includes; a signal controller which outputs a master image signal having first data information and second data information, a master data driver which samples the first data information and the second data information from the master image signal using a first sampling clock signal, generates a slave clock signal using the master image signal, and generates a slave image signal, which corresponds to the second data information, using the slave clock signal, and a slave data driver connected to the master data driver in a cascade manner, wherein the slave data driver samples the second data information from the slave image signal.

23 Claims, 15 Drawing Sheets

DATA DRIVING APPARATUS AND DISPLAY DEVICE USING THE SAME

This application claims priority to Korean Patent Application No. 10-2008-0124035, filed on Dec. 8, 2008, and all the benefits accruing therefrom under 35 U.S.C. §119, the contents of which in its entirety are herein incorporated by reference.

BACKGROUND OF THE INVENTION

1. Field of the Invention

The present invention relates to a data driving apparatus and a display device using the same.

2. Description of the Related Art

Flat panel displays ("FPDs"), such as organic light-emitting diode displays ("OLEDs"), plasma display panels ("PDPs"), and liquid crystal displays ("LCDs"), are being actively developed to replace heavy and large cathode ray tubes ("CRTs").

PDPs display characters or images using plasma generated by a gas discharge, and OLEDs display characters or images using electroluminescence of specific organic materials or polymers. In addition, LCDs apply an electric field to a liquid crystal layer interposed between two display panels and control the intensity of the electric field to adjust the amount of light that passes through the liquid crystal layer. In this way, LCDs display a desired image.

In particular, LCDs and OLEDs each typically include a display panel, a gate driver, a gray voltage generator, a data driver, and a signal controller. The display panel typically includes a plurality of pixels, each having a switching device, and display signal lines. The gate driver turns the switching device of each pixel on or off by transmitting a gate signal to gate lines of the display signal lines, and the gray voltage generator generates a plurality of gray voltages. The data driver selects a gray voltage from the plurality of gray voltages, which corresponds to image data, as a data voltage and applies the selected gray voltage to data lines of the display signal lines. The signal controller controls the display panel, the gate driver, the gray voltage generator, and the data driver.

Typically, each of the above drivers receives a voltage required for its operation and changes the received voltage into a plurality of voltages required for its operation. Specifically, the gate driver typically receives a gate-on voltage and a gate-off voltage and alternately applies the gate-on voltage and the gate-off voltage to the gate lines as a gate signal. The gray voltage generator typically receives a predetermined reference voltage, divides the reference voltage into a plurality of voltages by using a resistor, and provides the voltages to the data driver.

BRIEF SUMMARY OF THE INVENTION

Exemplary embodiments of the present invention provide a display device which is smaller and consumes less power than traditional display devices.

Exemplary embodiments of the present invention also provide a data driving apparatus which is smaller and consumes less power than traditional display devices.

However, exemplary embodiments of the present invention are not restricted to the one set forth herein. The above and other aspects of the present invention will become more apparent to one of ordinary skill in the art to which the present invention pertains by referencing the detailed description of the present invention given below.

According to an exemplary of the present invention, there a display device includes; a signal controller which outputs a master image signal having first data information and second data information, a master data driver which samples the first data information and the second data information from the master image signal using a first sampling clock signal, generates a slave clock signal using the master image signal, and generates a slave image signal, which corresponds to the second data information, using the slave clock signal, and a slave data driver connected to the master data driver in a cascade manner, wherein the slave data driver samples the second data information from the slave image signal.

According to another exemplary embodiment of the present invention, a data driving apparatus includes; a sampling clock generator which generates a first sampling clock signal and a second sampling clock signal having substantially the same frequency as the first sampling clock signal using a master image signal which includes first data information and second data information, a sampler which samples the first data information and the second data information using the first sampling clock signal, a slave clock generator which generates a slave clock signal using the second sampling clock signal, a slave image signal generator which generates a slave image signal, which corresponds to the second data information, using the slave clock signal, and a data voltage generator which generates a data voltage corresponding to the first data information.

BRIEF DESCRIPTION OF THE DRAWINGS

The above and other aspects, advantages and features of the present invention will become more apparent by describing in further detail exemplary embodiments thereof with reference to the attached drawings, in which.

DETAILED DESCRIPTION OF THE INVENTION

Figure 1:
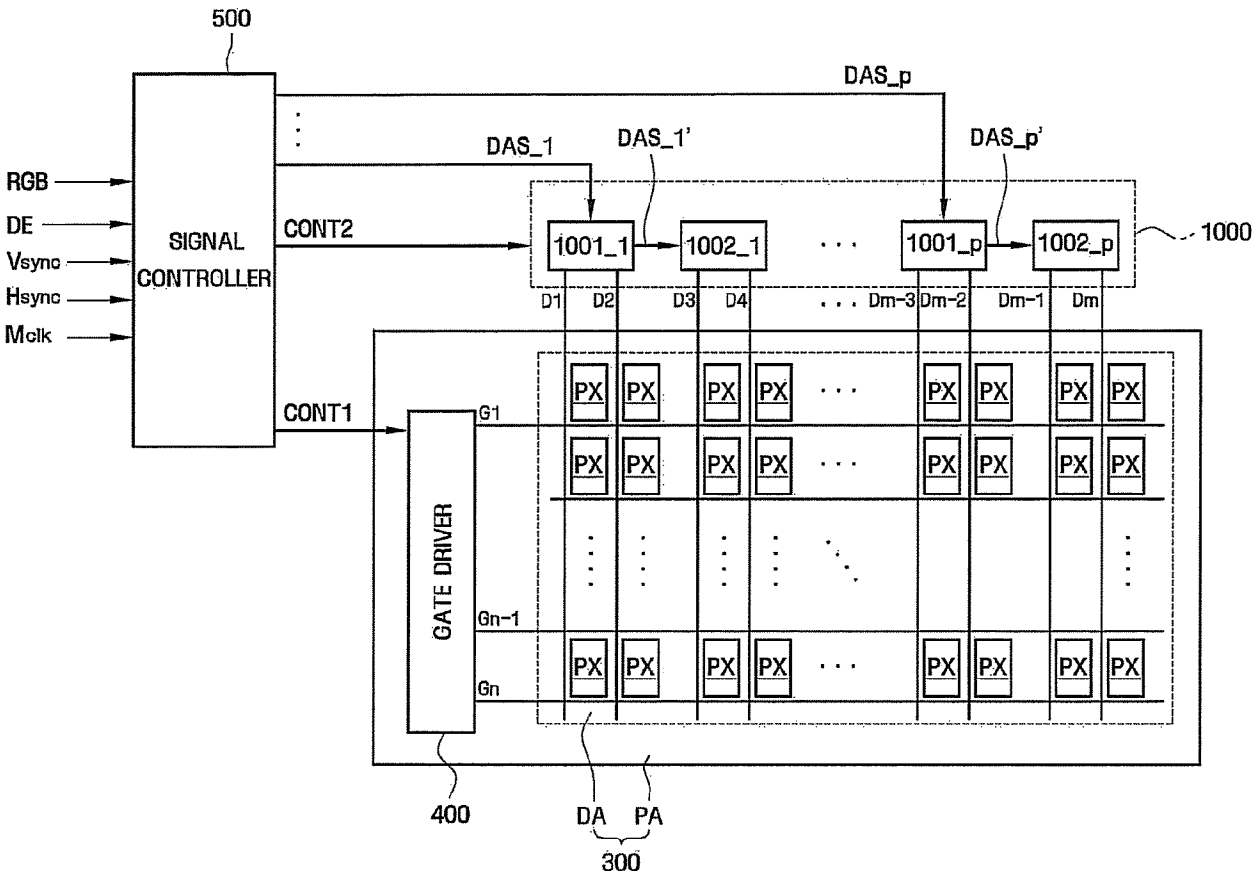
FIG. 1 is a block diagram of an exemplary embodiment of a display device according to the present invention.

The invention now will be described more fully hereinafter with reference to the accompanying drawings, in which exemplary embodiments of the invention are shown. The present invention may, however, be embodied in many different forms and should not be construed as being limited to the embodiments set forth herein. Rather, these embodiments are provided so that this disclosure will be thorough and complete and will fully convey the concept of the invention to those skilled in the art. Like reference numerals refer to like elements throughout the specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated steps, operations, components, and/or elements, but do not preclude the presence or addition of one or more other steps, operations, components, elements, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be described in detail with reference to the accompanying drawings.

Hereinafter, a display device according to an embodiment of the present invention will be described in detail with reference to FIGS. 1 through 9.

Figure 2:
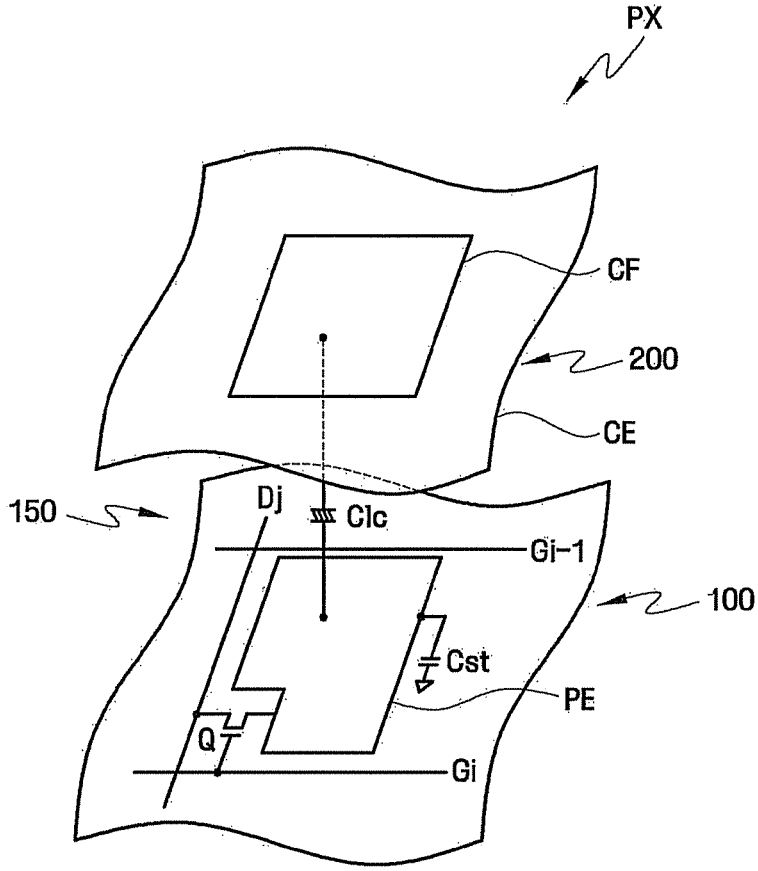
FIG. 2 is an equivalent circuit diagram of an exemplary embodiment of a pixel shown in FIG. 1.

FIG. 1 is a block diagram of an exemplary embodiment of a display device according to the present invention. FIG. 2 is an equivalent circuit diagram of an exemplary embodiment of a pixel PX shown in FIG. 1. In FIG. 1, two data lines are connected to each master data driver and each slave data driver as will be described in more detail below. However, the present invention is not limited thereto.

Referring to FIG. 1, the current exemplary embodiment of a display device includes a display panel 300, a signal controller 500, a gate driver 400, and a data driver 1000.

The display panel 300 includes a plurality of gate lines G1 through Gn, a plurality of data lines D1 through Dm, and a plurality of pixels PX and is divided into a display region DA where images are displayed and a non-display region PA where no images are displayed.

The display region DA, in which images are displayed, includes a first substrate 100 on which the gate lines G1 through Gn, the data lines D1 through Dm, a plurality of switching devices Q and a plurality of pixel electrodes PE are formed, a second substrate 200 on which a color filter CF and a common electrode CE are formed, and a liquid crystal layer 150 which is interposed between the first and second substrates 100 and 200. Exemplary embodiments include configurations wherein the color filter CF and common electrode CE may be formed on the first substrate 100. The gate lines G1 through Gn may extend in a substantially row direction to be substantially parallel to each other, and the data lines D1 through Dm may extend in a substantially columnar direction to be substantially parallel to each other and substantially perpendicular to the gate lines. The non-display region does not display images since, in the present exemplary embodiment, the first substrate 100 is wider than the second substrate 200.

The signal controller 500 receives an image signal RGB and input control signals for controlling the display of the image signal RGB and provides master image signals DAS_1 through DAS_p, gate control signals CONT1, and data control signals CONT2. In one exemplary embodiment, the signal controller 500 receives the image signal RGB and input control signals from an external graphics controller (not shown). Exemplary embodiments of the input control signals may include a vertical synchronization signal Vsync, a horizontal synchronization signal Hsync, a main clock signal Mclk, and a data enable signal DE. The signal controller 500 generates the master image signals DAS_1 through DAS_p and the data control signals CONT2 based on the image signal RGB and the input control signals and provides the master image signals DAS_1 through DAS_p and the data control signals CONT2 to the data driver 1000. In addition, the signal controller 500 generates the gate control signals CONT1 based on the input control signals and provides the gate control signals CONT1 to the gate driver 400.

In one exemplary embodiment, the master image signals DAS_1 through DAS_p may be clock-embedded signals, each including first and second data information, which correspond to a data voltage provided by the data driver 1000, and predetermined clock information used by the data driver 1000 to sample the first and second data information. Specifically, each of the master image signals DAS_1 through DAS_p may include first data information corresponding to a data voltage provided by a corresponding one of master data drivers 1001_1 through 1001_*p*, second data information corresponding to a data voltage provided by a corresponding one of slave data drivers 1002_1 through 1002_*p*, and clock information of a predetermined frequency used by the corresponding one of the master data drivers 1001_1 through 1001_*p*, which receive the master image signals DAS_1 through DAS_p, to sample the first and second data information. In addition, each of the master image signals DAS_1 through DAS_p may include information on whether the data driver 1000 is enabled and predetermined clock information used by the data driver 1000 to sample the information on whether the data driver 1000 is enabled.

Figure 6:
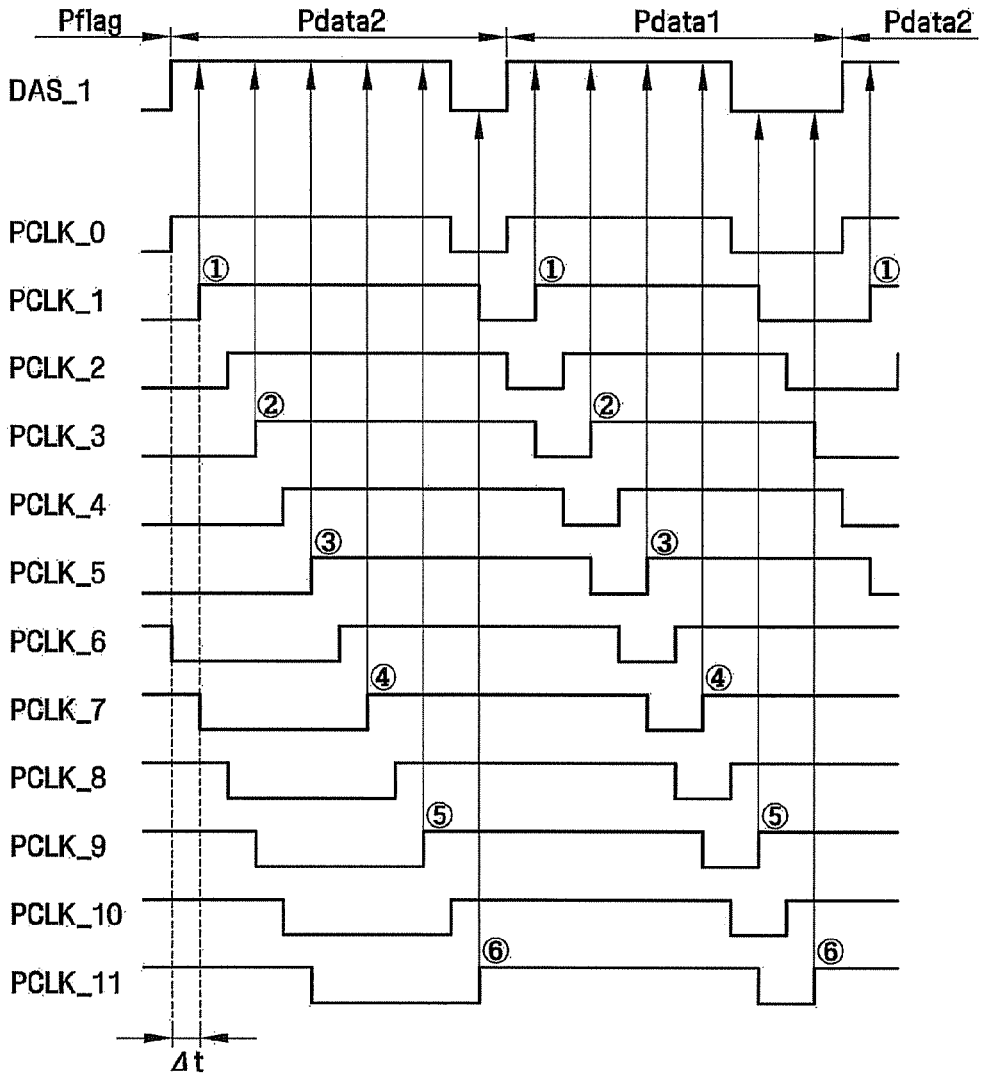
FIG. 6 is a diagram illustrating an exemplary embodiment of the sampling operation of an exemplary embodiment of a sampler shown in FIG. 4.

In one exemplary embodiment, each of the master image signals DAS_1 through DAS_p may be a clock signal which has rising edges at regular intervals but has falling edges at irregular intervals as shown in, and discussed in more detail with respect to, FIG. 6. Here, the clock signal goes from low to high at each rising edge and goes from high to low at each falling edge. The first and second data information and the information on whether the data driver 1000 is enabled, all of which are included in each of the master image signals DAS_1 through DAS_p, may be determined by a duty ratio of each of the master image signals DAS_1 through DAS_p in first and second data sections Pdata1 and Pdata2 and a flag section Pflag. In addition, the clock information may be determined by rising edge times of each of the master image signals DAS_1 through DAS_p. Here, a duty ratio may denote the proportion of time, during which each of the master image signals DAS_1 through DAS_p remains high, in a period defined by each rising edge of each of the master image signals DAS_1 through DAS_p. The duty ratio will be described in greater detail later with reference to FIG. 6.

The data control signals CONT2 are used to control the operation of the data driver 1000. Exemplary embodiments of the data control signals CONT2 may include a horizontal start signal STH for starting the operation of the data driver 1000 and a load signal "load" for instructing the data lines D1 through Dm to output data voltages. Exemplary embodiments of the data control signals CONT2 may further include an inversion signal for inverting the polarity of a data voltage with respect to a data common voltage Vcom (hereinafter, "the polarity of a data voltage with respect to a data common voltage Vcom" will be shortened to "the polarity of a data voltage").

The gate control signals CONT1 are used to control the operation of the gate driver 400. Exemplary embodiments of the gate control signals CONT1 may include a scan start signal for starting the operation of the gate driver 400 in each frame and at least one gate clock signal for controlling the output cycle of the gate-on voltage. In addition, the gate control signals CONT1 may include an output enable signal OE for controlling the duration of the gate-on voltage.

The gate driver 400 receives the gate control signals CONT1, a gate-on voltage Von and a gate-off voltage Voff and provides the gate-on voltage Von to the gate lines G1 through Gn sequentially. Specifically, the gate driver 400 is enabled in response to the scan start signal in each frame and sequentially provides the gate-on voltage Von to the gate lines G1 through Gn in response to the gate clock signal. In one exemplary embodiment, as shown in FIG. 1, the gate driver 400 may be formed in the non-display region PA of the display panel 300 and thus may be connected to the display panel 300. However, the present invention is not limited thereto, and alternative exemplary embodiments include configurations wherein the gate driver 400 may be mounted on a flexible printed circuit film in the form of an integrated circuit and then attached to the display panel 300 in the form of a tape carrier package ("TCP"). Alternative exemplary embodiments also include configurations wherein the gate driver 400 may be mounted on a separate printed circuit board ("PCB"). While the gate driver 400 is disposed on a side of the display panel 300 in the drawing, the present invention is not limited thereto. That is, in other exemplary embodiments of a display device according to the present invention, the gate driver 400 may include first and second gate drivers which are disposed on both sides of the display panel 300, respectively.

The data driver 1000 receives gray voltages, the master image signals DAS_1 through DAS_p, and the data control signals CONT2 and provides a data voltage, which corresponds to the first and second data information included in each of the master image signals DAS_1 through DAS_p, to each of the data lines D1 through Dm. The data driver 1000 includes the master data drivers 1001_1 through 1001_*p* which output data voltages corresponding to the first data information to the data lines and the slave data drivers 1002_1 through 1002_*p* which output data voltages corresponding to the second data information to the data lines. In one exemplary embodiment, the data driver 1000 may be formed as an integrated circuit connected to the display panel 300 in the form of a TCP. However, the present invention is not limited thereto, and alternative exemplary embodiments include configurations wherein the data driver 1000 may be formed in the non-display region PA of the display panel 300.

The master data drivers 1001_1 through 1001_*p* and the slave data drivers 1002_1 through 1002_*p* of the display device according to the present exemplary embodiment will now be described in more detail.

Referring to FIG. 2, in each pixel PX of FIG. 1, the color filter CF may be formed in a region of the common electrode CE on the second substrate 200 to face a pixel electrode PE of the first substrate 100. In one exemplary embodiment, each pixel PX may be connected to an $i^{th}$ (i=1 to n) gate line Gi and a $j^{th}$ (j=1 to m) data line Dj. In addition, each pixel PX may include a switching device Q, which is connected to the $i^{th}$ gate line Gi and the $j^{th}$ data line Dj, and a liquid crystal capacitor Clc and a storage capacitor Cst which are connected to the switching device Q. Exemplary embodiments include configurations where the storage capacitor Cst may be omitted. In one exemplary embodiment, the switching device Qp may be a thin-film transistor made of amorphous silicon (a-Si) (hereinafter, referred to as an "a-Si TFT"). The color filter CF is formed on the second substrate 200 having the common electrode CE. However, the present invention is not limited thereto, and the color filter CF may also be formed on the first substrate 100 as described briefly above.

Figure 3:
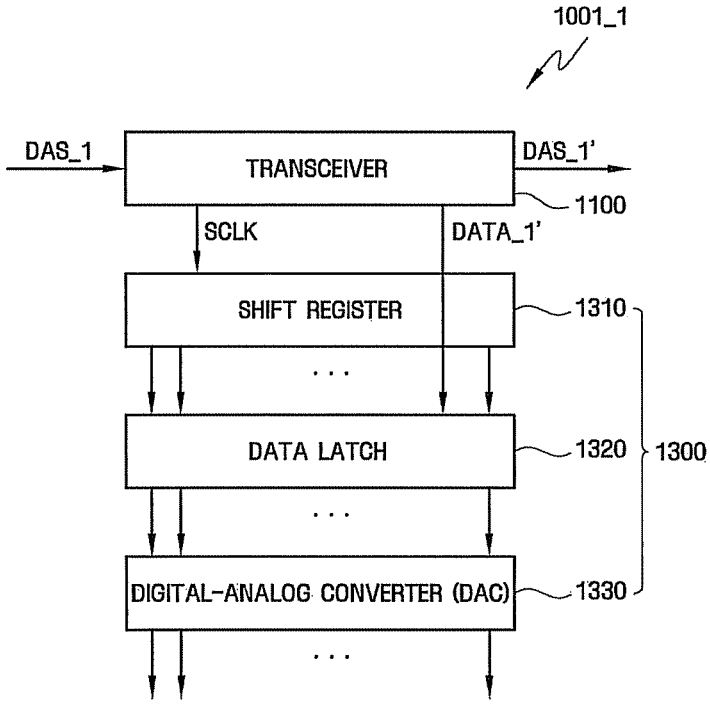
FIG. 3 is a block diagram of an exemplary embodiment of a master data driver included in the exemplary embodiment of a display device of FIG. 1.

FIG. 3 is a block diagram of an exemplary embodiment of one of the master data drivers 1001_1 through 1001_*p* included in the exemplary embodiment of a display device according to the present embodiment. In the drawing, the configuration of the master data driver 1000_1 is shown as but one exemplary embodiment. However, the present invention is not limited thereto, and the other master data drivers 1001_2 through 1001_*p* may also be configured in the same way as the master data driver 1001_1.

Referring to FIG. 3, the master data driver 1001_1 receives the master image signal DAS_1, which includes the first and second data information, from the signal controller 500, applies a data voltage corresponding to the first data information to data lines, and provides a slave image signal DAS_1' corresponding to the second data information to the slave data driver 1002_1. Similar to the master image signal DAS_1, the slave image signal DAS_1' may be a clock-embedded signal which includes the second data information and predetermined clock information used by the slave data driver 1002_1 to sample the second data information. In the present exemplary embodiment, the master data driver 1001_1 is connected to the signal controller 500 in a point-to-point manner as shown in FIG. 1 and includes a transceiver 1100 and a data voltage generator 1300.

The transceiver 1100 receives the master image signal DAS_1, which includes the first and second data information, provides a first data signal DATA_1', which corresponds to the first data information as described above, to the data voltage generator 1300, and provides the slave image signal DAS_1', which corresponds to the second data information as described above, to the slave data driver 1002_1. The transceiver 1100 will be described in more detail later with reference to FIGS. 4 through 11B.

The data voltage generator 1300 receives the first data signal DATA_1' in parallel from the transceiver 1100 via a plurality of lines and provides a data voltage corresponding to the first data signal DATA_1' to corresponding ones of the data lines D1 through Dm. Specifically, the data voltage generator 1300 receives a plurality of gray voltages from a gray voltage generator (not shown), generates a data voltage corresponding to the first data signal DATA_1' using at least one of the received gray voltages, and provides the data voltage to data lines connected to the master data driver 1001_1. Exemplary embodiments of the data voltage generator 1300 may include a shift register 1310, a data latch 1320, and a digital-analog converter ("DAC") 1330 as shown in FIG. 3.

The shift register 1310 receives a source clock signal SCLK from the transceiver 1100 and enables the data latch 1320. When enabled by the shift register 1310, the data latch 1320 receives the first data signal DATA_1'. When disabled, the data latch 1320 maintains the received first data signal DATA_1' until enabled again by the shift register 1310. In the present exemplary embodiment, the source clock signal SCLK may be generated using sampling clock signals which are generated by a sampling clock signal generator (not shown in FIG. 3) of the transceiver 1100.

Meanwhile, the data latch 1320 may output the first data signal DATA_1' at a time in response to a rising edge of the load signal of CONT 2, and provide the first data signal DATA_1' to the DAC 1330.

The DAC 1330 receives the first data signal DATA_1' from the data latch 1320 and outputs an analog data voltage corresponding to the first data signal DATA_1'. Specifically, the DAC 1330 may generate the analog data voltage corresponding to the first data signal DATA_1' using a plurality of gray voltages provided by the gray voltage generator and provide the generated analog data voltage to data lines. Here, the DAC 1330 may output the analog data voltage in response to a falling edge of the load signal.

In one exemplary embodiment, when a frame begins, the polarity of a data voltage applied to each pixel may be changed to a polarity opposite to that in a previous frame ("frame inversion"). Exemplary embodiments also include configurations wherein even within a frame, the polarity of a data voltage flowing through a data line may change periodically according to characteristics of an inversion signal (e.g., "row inversion" or "dot inversion"), or data voltages with opposite polarities may be applied respectively to every two neighbouring pixels in each row (e.g., "column inversion" or "dot inversion"). Exemplary embodiments also include configurations wherein no inversion is performed.

The transceiver 1100 of the master data driver 1001_1 will now be described in detail with reference to FIGS. 4 through 11B.

Figure 4:
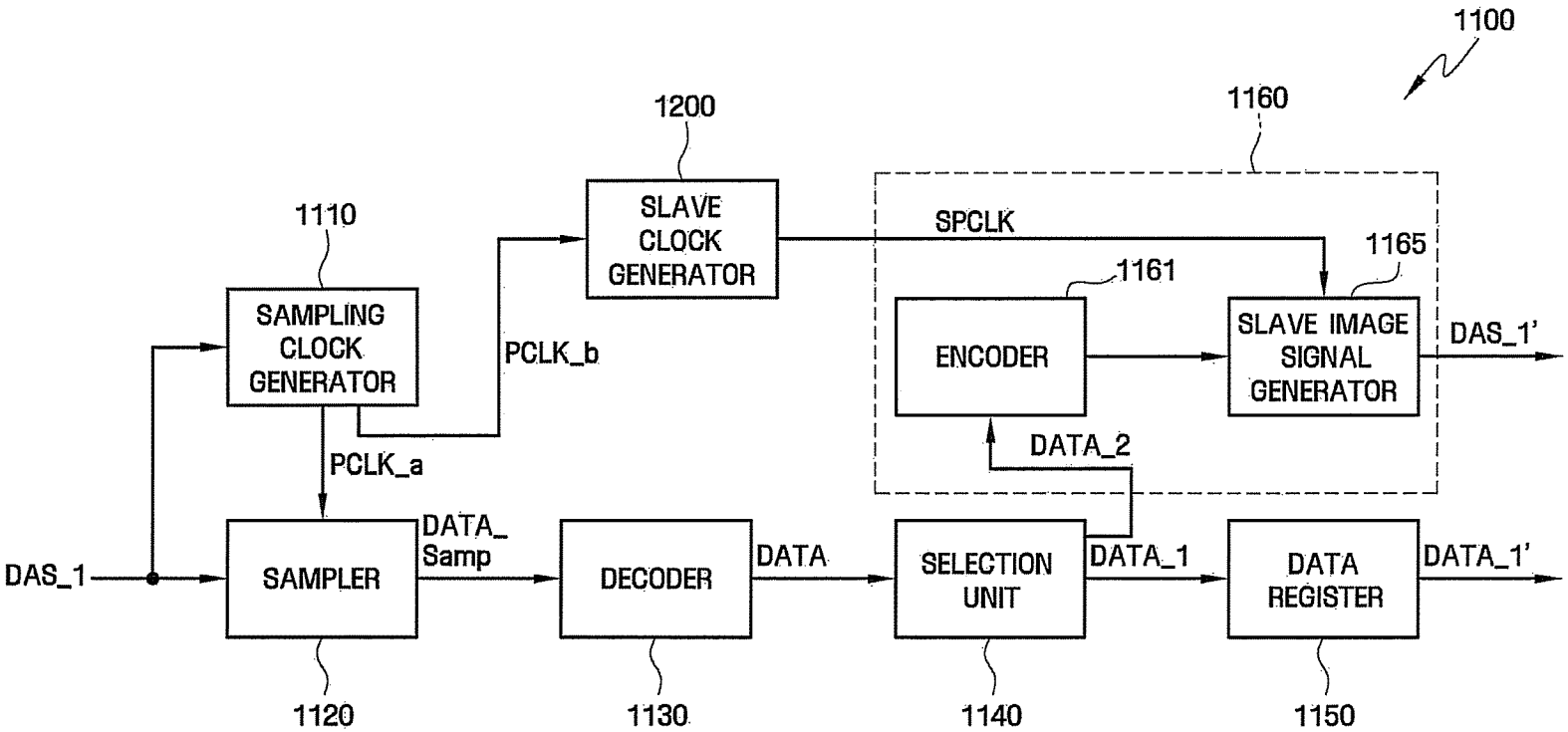
FIG. 4 is a block diagram of an exemplary embodiment of a transceiver shown in FIG. 3.
Figure 5:
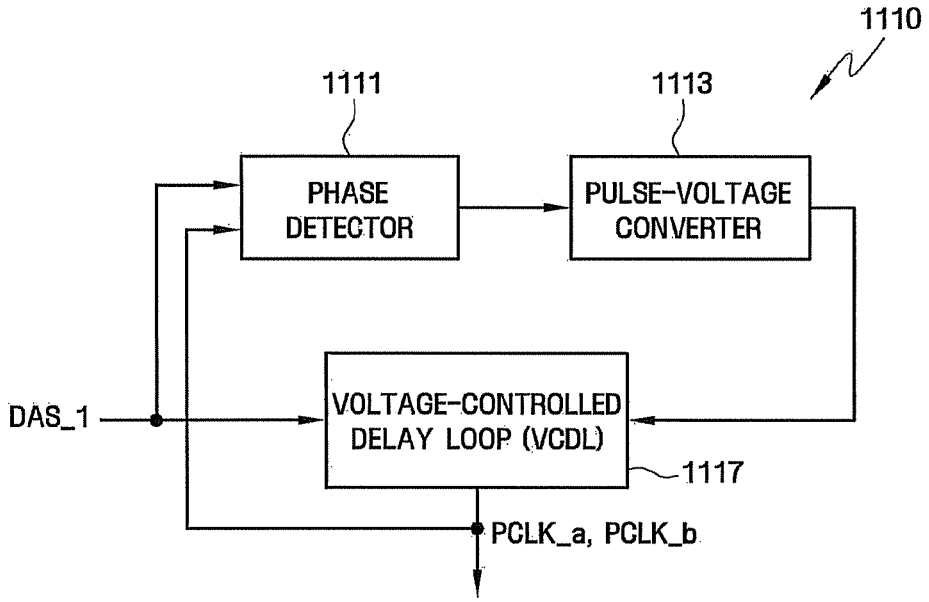
FIG. 5 is a block diagram of an exemplary embodiment of a sampling clock generator shown in FIG. 4.

FIG. 4 is a block diagram of an exemplary embodiment of the transceiver 1100 shown in FIG. 3. FIG. 5 is a block diagram of an exemplary embodiment of the sampling clock generator 1110 shown in FIG. 4. FIG. 6 is a diagram illustrating an exemplary embodiment of the sampling operation of an exemplary embodiment of a sampler 1120 shown in FIG. 4. For simplicity, an exemplary embodiment where the sampling clock generator 1110 generates a plurality of sampling clock signals having twelve different phases will be described as an example. However, the present invention is not limited thereto. That is, exemplary embodiments include configurations wherein the number of sampling clock signals generated by the sampling clock generator 1110 may vary according to the format of the master image signal DAS_1.

Referring to FIG. 4, the exemplary embodiment of a transceiver 1100 may include the sampling clock generator 1110, the sampler 1120, a decoder 1130, a selection unit 1140, a data register 1150, a slave clock generator 1200, and a slave image signal transmitter unit 1160.

The sampling clock generator 1110 generates a plurality of sampling clock signals, which include first and second sampling clock signals PCLK_a and PCLK_b, using the master image signal DAS_1. In the present exemplary embodiment, the first sampling clock signals PCLK_a may be provided to the sampler 1120 and used to sample the first and second data information. In addition, the second sampling clock signals PCLK_b may be provided to the slave clock generator 1200 and used to generate slave clock signals SPCLK. In the present exemplary embodiment, the second sampling clock signals PCLK_b may have substantially the same frequency (or cycle) as the first sampling clock signals PCLK_a.

Specifically, by using the clock information included in the master image signal DAS_1, the sampling clock generator 1110 may generate a plurality of sampling clock signals PCLK_0 through PCLK_11 having different phases as shown in FIG. 6. Here, there is a time interval Δt between respective rising edges of the sampling clock signals PCLK_0 through PCLK_11 having different phases (e.g., between respective rising edges of the sampling clock signals PCLK_0 and PCLK_1). The sampling clock signals PCLK_0 through PCLK_11 may selectively be provided to the sampler 1120 or the slave clock generator 1200 via different signal lines (not shown).

As shown in FIG. 5, in one exemplary embodiment, the sampling clock generator 1110 may be implemented as a delay locked loop ("DLL") circuit which includes a voltage-controlled delay loop ("VCDL") 1117, a phase detector 1111, and a pulse-voltage converter 1113.

The VCDL 1117 receives the master image signal DAS_1, delays the master image signal DAS_1 according to a voltage received from the pulse-voltage converter 1113, and outputs the delayed master image signal DAS_1. In one exemplary embodiment, the VCLD 1117 may include a plurality of inverters which are connected to each other in a cascade manner and output the sampling clock signals PCLK_0 through PCLK_11, which are obtained by delaying the master image signal DAS_1, through an output terminal of each inverter.

The phase detector 1111 compares a phase of the master image signal DAS_1 delayed by the VCDL 1117 with that of the master image signal DAS_1 received from the signal controller 500 and determines how long the master image signal DAS_1 output from the VCDL 1117 has been delayed. Specifically, the phase detector 1111 may output a pulse having a positive value or a negative value according to the phase difference between the master image signal DAS_1 delayed by the VCDL 1117 and the master image signal DAS_1 received from the signal controller 500.

The pulse-voltage converter 1113 converts a pulse value provided by the phase detector 1111 into a voltage and provides the voltage to the VCDL 1117. Specifically, the pulse-voltage converter 1113 may receive a pulse having a positive value from the phase detector 1111 and provide a voltage having a higher level to the VCDL 1117. In addition, the pulse-voltage converter 1113 may receive a pulse having a negative value and provide a voltage having a lower level to the VCDL 1117. In one exemplary embodiment, the pulse-voltage converter 1113 may include a charge pump which controls the amount of electric charge according to a pulse provided by the phase detector 1111 and a loop filter which determines a voltage value provided to the VCDL 1117.

While the sampling clock generator 1110 is illustrated as a DLL circuit as shown in FIG. 5, the present invention is not limited thereto. Exemplary embodiments include configurations wherein the sampling clock generator 1110 may also be implemented in various forms, for example, as a phase locked loop ("PLL") circuit.

The sampler 1120 samples the first and second data information from the master image signal DAS_1 using the first sampling clock signals PCLK_a. That is, the sampler 1120 may sample the first and second data information from the master image signal DAS_1 using a portion (e.g., PCLK_1, PCLK_3, PCLK_5, PCLK_7, PCLK_9, and PCLK_11) of the sampling clock signals PCLK_0 through PCLK_11 generated by the sampling clock generator 1110.

The operation of the sampler 1120 will now be described in more detail with reference to FIG. 6.

Referring to FIG. 6, the master image signal DAS_1 may include the second data section Pdata2 and the first data section Pdata1. In the present exemplary embodiment, the second data section Pdata2 includes the second data information corresponding to a data voltage provided to the slave data driver 1002_1, and the first data section Pdata1 includes the first data information corresponding to a data voltage provided to the master data driver 1001_1. In one exemplary embodiment, the master image signal DAS_1 may further include the flag section Pflag which precedes the first and second data sections Pdata1 and Pdata2 and contains the information on whether the data driver 1000 is enabled. Each of the first and second data sections Pdata1 and Pdata2 and the flag section Pflag combined may be equal to a period of the master image signal DAS_1, and the first and second information and the information on whether the data driver 1000 is enabled may be determined by duty ratios of the master image signal DAS_1 in the first and second data sections Pdata1 and Pdata2 and the flag section Pflag, respectively. In one exemplary embodiment, if the master image signal DAS_1 has rising edges at regular intervals, a period of the master image signal DAS_1 may refer to a period of time between the rising edges.

In one exemplary embodiment, if an image displayed by a pixel is composed of 8-bit data information and if a period of the master image signal DAS_1 includes 2-bit data information as shown in FIG. 6, the 2-bit data information of the image displayed by the pixel may be delivered over four periods of the master image signal DAS_1. However, the present invention is not limited thereto. That is, in alternative exemplary embodiments, the number of bits of data information included in a period of the master image signal DAS_1 and the number of bits of data information of an image displayed by a pixel may vary according to requirements of a designer.

In the drawing, the second data section Pdata2 corresponding to a data voltage provided to the slave data driver 1002_1 and the first data section Pdata1 corresponding to a data voltage provided to the master data driver 1001_*p* are alternately arranged in the presented order. However, the present invention is not limited thereto. Alternative exemplary embodiments of the present invention include configurations wherein the first and second data sections Pdata1 and Pdata2 may be alternately arranged so that the Pdata1 data section is presented first.

The sampler 1120 may sample the information on whether the data driver 1000 is enabled and the first and second data information from the master image signal DAS_1 using the first sampling clock signals (e.g., PCLK_1, PCLK_3, PCLK_5, PCLK_7, PCLK_9, and PCLK_11). Specifically, the sampler 1120 may sample a level of the master image signal DAS_1 in each of the flag section Pflag and the first and second data sections Pdata1 and Pdata2 in response to a rising edge of each of the first sampling clock signals (e.g., PCLK_1, PCLK_3, PCLK_5, PCLK_7, PCLK_9, and PCLK_11). In so doing, the sampler 1120 may sample the information on whether the data driver 1000 is enabled and the first and second data information from the master image signal DAS_1.

In one exemplary embodiment, when the information on whether the data driver 1000 is enabled and the first and second data information, which are included in the master image signal DAS_1, are defined as shown in Table 1 below according to duty ratios of the master image signal DAS_1 in the flag section Pflag and the first and second data sections Pdata1 and Pdata2, respectively, the sampler 1120 may sample the level of the master image signal DAS_1 by using six sampling clock signals (e.g., PCLK_1, PCLK_3, PCLK_5, PCLK_7, PCLK_9, and PCLK_11).

TABLE 1

| DATA_sample | DATA |
|---|---|
| 100000 | 00 |
| 110000 | 01 |
| 111000 | SC |
| 111100 | 10 |
| 111110 | 11 |

Here, "DATA_sample" indicates a signal sampled by the sampler 1120 in each section Pflag, Pdata2 or Pdata 1 of the master image signal DAS_1, and "DATA" indicates a signal decoded by the decoder 1130 using the sampled signal DATA_sample. In addition, "00," "01," "10," and "11" denote logic levels of a 2-bit first data signal DATA_1 corresponding to the first data information or a 2-bit second data signal DATA_2 corresponding to the second data information, and "SC" denotes a level indicating that the data driver 1000 is enabled.

Specifically, referring to FIG. 6, the sampler 1120 may sample the level, i.e., "111110", of the master image signal DAS_1 in the second data section Pdata2 in response to a rising edge of each of the first sampling clock signals (e.g., PCLK_1, PCLK_3, PCLK_5, PCLK_7, PCLK_9, and PCLK_11). In the first data section Pdata1, the sampler 1120 may sample the level, i.e., "111100", of the master image signal DAS_1 in response to the rising edge of each of the first sampling clock signals (e.g., PCLK_1, PCLK_3, PCLK_5, PCLK_7, PCLK_9, and PCLK_11).

The decoder 1130 decodes the signal DATA_sample sampled by the sampler 1120. In one exemplary embodiment, the decoder 1130 may include a multiplexer. However, the present invention is not limited thereto. Alternative exemplary embodiments include configurations wherein the decoder 1130 may be configured in various forms.

The selection unit 1140 receives the signal DATA decoded by the decoder 1130 and provides the first data signal DATA_1 corresponding to the first data information and the second data signal DATA_2 corresponding to the second data information to the data voltage generator 1300 and a slave image signal generator 1165, respectively. Specifically, the selection unit 1140 provides the first data signal DATA_1, which corresponds to a data voltage provided by the master data driver 1001_1, to the data voltage generator 1300 via the data register 1150 and provides the second data signal DATA_2, which corresponds to a data voltage provided by the slave data driver 1002_*p*, to the slave image signal generator 1165 via an encoder 1161. In the present exemplary embodiment, the first data signal DATA_1 may be converted into the first data signal DATA_1' in a parallel form and provided accordingly to the data voltage generator 1300 via the data register 1150.

Figure 7:
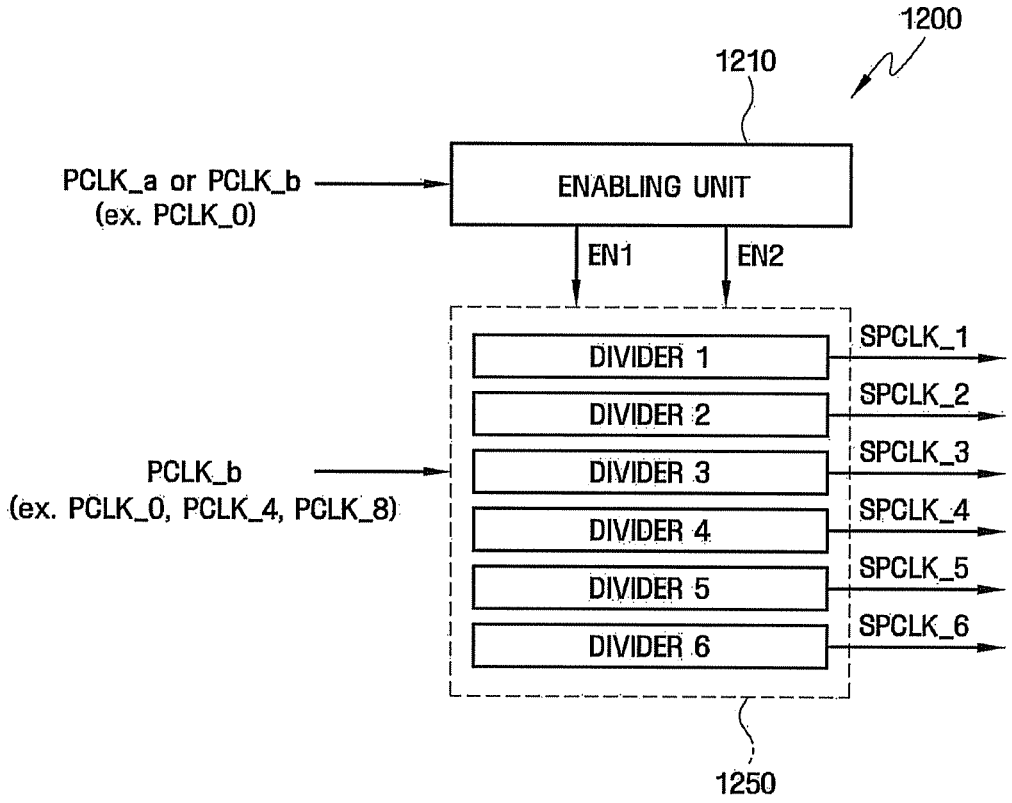
FIG. 7 is a block diagram of an exemplary embodiment of a slave clock generator shown in FIG. 4.

FIG. 7 is a block diagram of an exemplary embodiment of the slave clock generator 1200 shown in FIG. 4. For simplicity, the present exemplary embodiment of a dividing unit 1250 which receives the second sampling clock signals and halves the received second sampling clock signals will be described. However, the present invention is not limited thereto. In addition, the signals PCLK_0, PCLK_4, and PCLK_8 will be described as the second sampling clock signals provided to the dividing unit 1250. However, the present invention is not limited thereto. Alternative exemplary embodiments include configurations wherein the second sampling clock signals provided to the dividing unit 1250 may also be a group of sampling clock signals (a group of PCLK_1, PCLK_5 and PCLK_8, a group of PCLK_2, PCLK_6 and PCLK_9, or a group of PCLK_3, PCLK_7, and PCLK11) whose respective rising edges are separated from each other by a predetermined period of time 4 Δt.

Referring to FIG. 7, the slave clock generator 1200 provides slave clock signals SPCLK_1 through SPCLK_6 using the second sampling clock signals (e.g., PCLK_0, PCLK_4, and PCLK_8). Specifically, the slave clock generator 1200 may divide the second sampling clock signals PCLK_0, PCLK_4, and PCLK_8 and generate the slave clock signals SPCLK_1 through SPCLK_6 having shorter frequencies than those of the second sampling clock signals PCLK_0, PCLK_4, and PCLK_8. In one exemplary embodiment, the slave clock generator 1200 may include an enabling unit 1210 and the dividing unit 1250 which includes a plurality of dividers 1250_1 through 1250_6 as shown in FIG. 7.

The enabling unit 1210 generates first and second enable signals EN1 and EN2 by using a first or second sampling clock signal PCLK_a or PCLK_b provided by the sampling clock generator 1110. In the present exemplary embodiment, a sampling clock signal provided to the enabling unit 1210 may be a second sampling clock signal (e.g., PCLK_0) whose rising edge comes earliest from among a plurality of second sampling clock signals (e.g., PCLK_0, PCLK_4, and PCLK_8) provided to the dividing unit 1250 or a first sampling clock signal whose rising edge precedes the rising edge of the above second sampling clock signal. In the present exemplary embodiment, rising edge times of a plurality of sampling clock signals (e.g., PCLK_0 through PCLK_11) may be compared in each of the sections Pflag, Pdata2 and Pdata1. For simplicity, the enabling unit 1210 using the signal PCLK_0 whose rising edge comes earliest from among the second sampling clock signals PCLK_0, PCLK_4, and PCLK_8 will be described as an example. However, the present invention is not limited thereto.

Figure 8A:
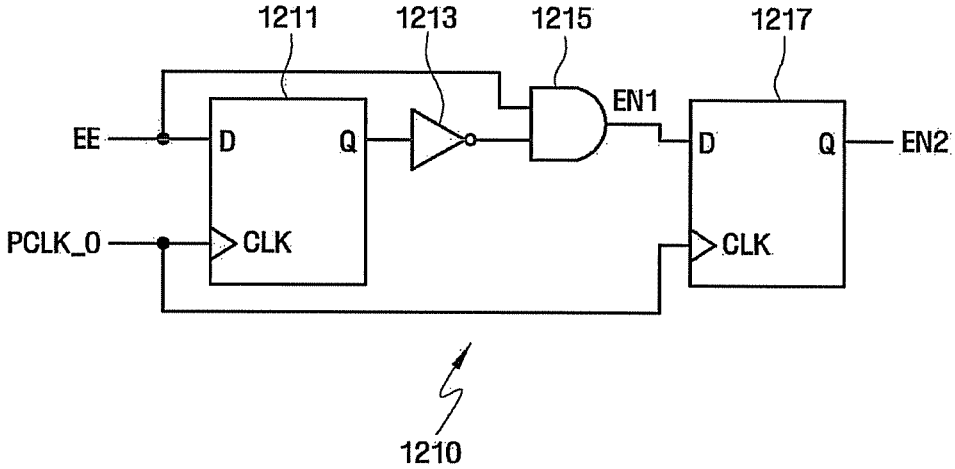
FIG. 8A is a circuit diagram of an exemplary embodiment of an enabling unit shown in FIG. 7.

The present exemplary embodiment of an enabling unit 1210 generates the first and second enable signals EN1 and EN2 using the second sampling clock signal PCLK_0 and provides the first and second enable signals EN1 and EN2 respectively to first and second dividers included in the dividing unit 1250. Thus, the first and second dividers can selectively be enabled. That is, the enabling unit 1210 may control times when the first and second dividers are enabled using the first and second enable signals EN1 and EN2, respectively. In one exemplary embodiment, the enabling unit 1210 may enable the first dividers at a first period (or a first rising edge time) of the second sampling clock signal PCLK_0 and enable the second dividers at a second period (or a second rising edge time) of the second sampling clock signal PCLK_0. In one exemplary embodiment, the enabling unit 1210 may be configured as shown in FIG. 8A. However, the present invention is not limited thereto. Exemplary embodiments of the enabling unit 1210 can be configured in various circuit forms as long as it performs the same operation.

Figure 8B:
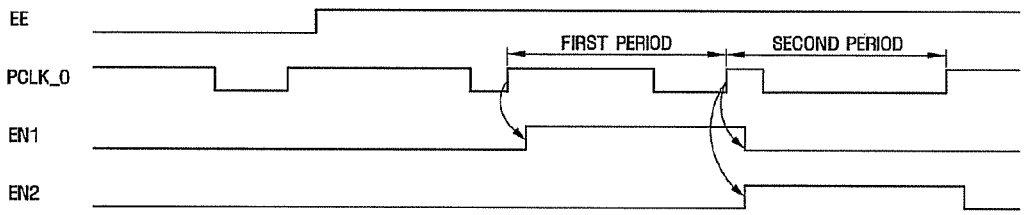
FIG. 8B is a diagram illustrating the operation of the exemplary embodiment of an enabling unit shown in FIG. 8A.

FIG. 8A is a circuit diagram of the exemplary embodiment of an enabling unit 1210 shown in FIG. 7. FIG. 8B is a diagram illustrating an exemplary embodiment of the operation of the enabling unit 1210 shown in FIG. 8A.

Referring to FIGS. 8A and 8B, the present exemplary embodiment of an enabling unit 1200 may include first and second flip-flops 1211 and 1217, an inverter 1213, and an AND gate 1215. The first flip-flop 1211 may receive an enable instruction signal EE and output the enable instruction signal EE in response to the second sampling clock signal PCLK_0. The AND gate 1215 may perform an AND operation on an output of the first flip-flop 1211, which is received via the inverter 1210, and the enable instruction signal EE and output the first enable signal EN1. The second flip-flop 1217 may receive the first enable signal EN1 and output the second enable signal EN2 in response to the second sampling clock signal PCLK_0. In one exemplary embodiment, the enable instruction signal EE may be provided at a set-up time of the enabling unit 120, that is, before a rising edge of a first period of the enable instruction signal EE.

Thus, as shown in FIG. 8B, the enabling unit 1210 of FIG. 8A may provide the first enable signal EN1, which is high in the first period of the second sampling clock signal PCLK_0, and the second enable signal EN2 which is high in the second period of the second sampling clock signal PCLK_0. While D-flip-flops are shown as the first and second flip-flops 1211 and 1277 in the exemplary embodiment of an enabling unit of FIG. 8A, the present invention is not limited thereto.

The dividing unit 1250 includes the dividers 1250_1 through 1250_6 which divide the second sampling clock signals PCLK_0, PCLK_4 and PCLK_8 and output the slave clock signals SPCLK_1 through SPCLK_6. The dividers 1250_1 through 12506 may include the first dividers 1250_1 through 1250_3 which receive the second sampling clock signals PCLK_0, PCLK_4 and PCLK_8 and output first slave clock signals SPCLK_1 through SPCLK_3, respectively, and the second dividers 1250_4 through 1250_6 which receive the second sampling clock signals PCLK_0, PCLK_4, and PCLK_8 and output second slave clock signals SPCLK_4 through SPCLK_6, respectively.

Specifically, the first dividers 1250_1 through 1250_3 may be initiated and enabled by the first enable signal EN1. Then, the first dividers 1250_1 through 1250_3 may divide (e.g., halve) the second sampling clock signals PCLK_0, PCLK_4 and PCLK_8 and provide the first slave clock signals SPCLK_1 through SPCLK_3, respectively. On the other hand, the second dividers 1250_4 through 1250_6 may be initiated and enabled by the second enable signal EN2. Then, the second dividers 12504 through 1250_6 may divide (e.g., halve) the second sampling clock signals PCLK_0, PCLK_4 and PCLK_8 and provide the second slave clock signals SPCLK_4 through SPCLK_6, respectively.

Figure 9:
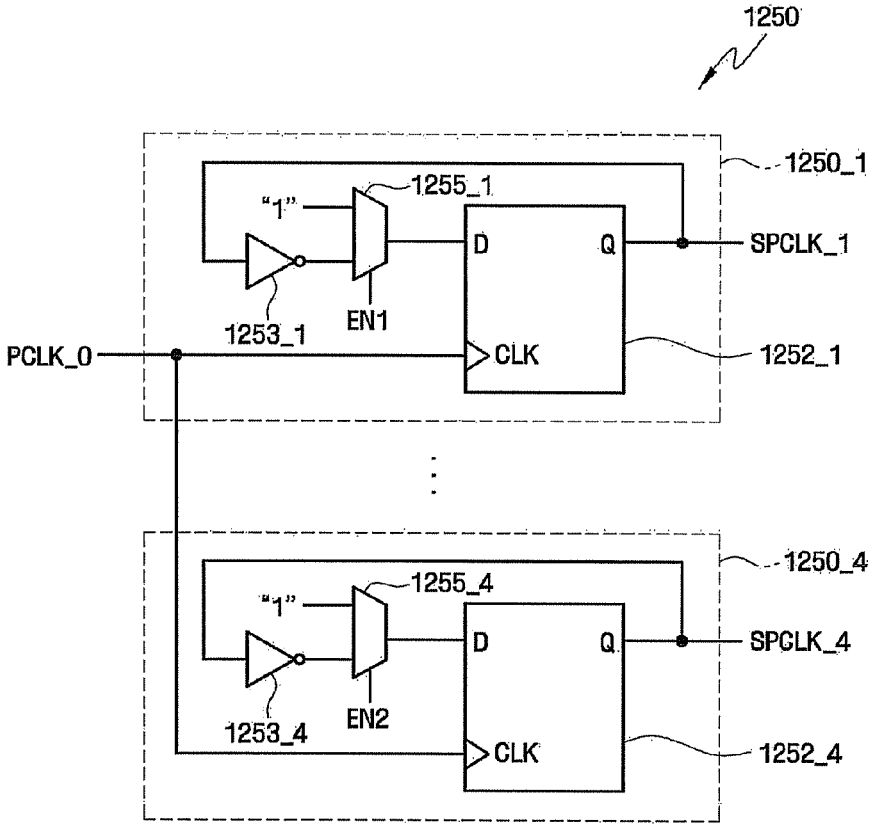
FIG. 9 is a circuit diagram of an exemplary embodiment of a dividing unit shown in FIG. 7.
Figure 10:
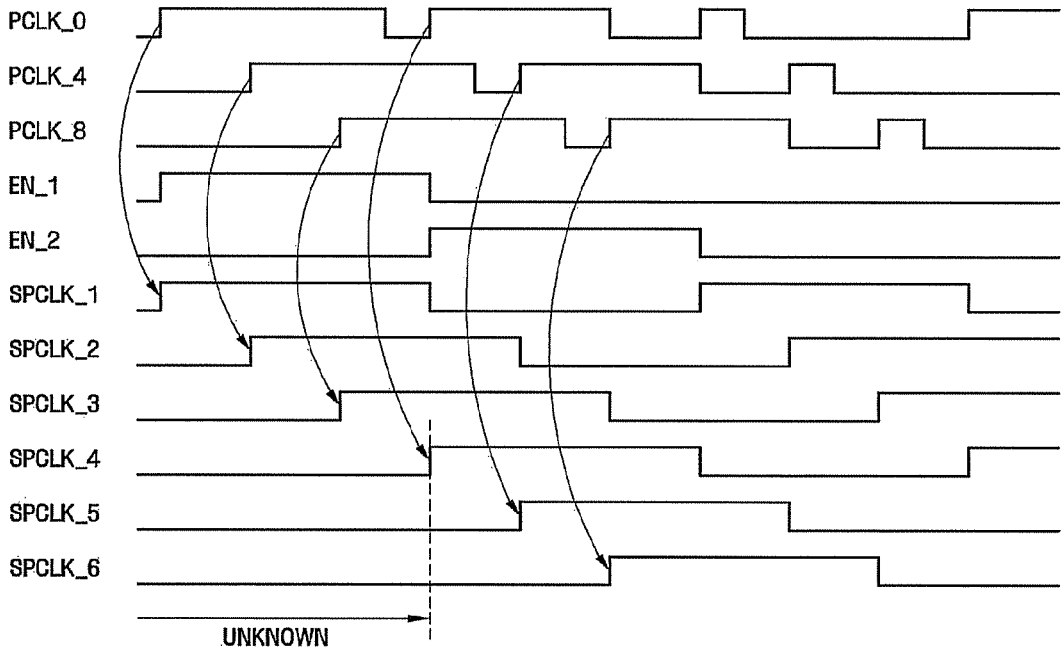
FIG. 10 is a diagram illustrating the operation of the exemplary embodiment of a dividing unit shown in FIG. 7.

FIG. 9 is a circuit diagram of an exemplary embodiment of the dividing unit 1250 shown in FIG. 7. FIG. 10 is a diagram for explaining the operation of the dividing unit 1250 shown in FIG. 7. While the dividers 1250_1 and 1250_4 providing the slave clock signals SPCLK_1 and SPCLK_4, respectively, are shown in FIG. 9, the present invention is not limited thereto. The other dividers 1250_2, 1250_3, 1250_5, and 1250_6 may also be configured in a similar manner as the dividers 1250_1 and 1250_4.

Referring to FIG. 9, the dividers 1250_1 and 1250_4 may include selectors 1255_1 and 1255_4, flip-flops 1252_1 and 1252_4, and inverters 1253_1 and 1253_4, respectively. Specifically, each of the dividers 1250_1 and 1250_4 may include the selector 1255_1 or 1255_4 which selectively outputs logic level "1" and a slave clock signal inverted by the inverter 1253_1 or 1253_4 in response to the first or second enable signal EN1 or EN2, respectively. In addition, each of the dividers 1250_1 and 1250_4 may include the flip-flop 1252_1 or 1252_4 which receives an output of the selector 1255_1 or 1255_4 and outputs the slave clock signal SPCLK_1 or SPCLK_4 in response to the second sampling clock signal PCLK_0. Here, the first divider 1250_1 may be configured to be substantially similar to the second divider 1250_4 except that the first divider 1250_1 has the first enable signal EN1 sent to the selector 1255_1 while the second divider 1250_4 has the second enable signal EN2 sent to the selector 1255_4.

Referring to FIG. 10, each of the first and second dividers 1250_1 and 1250_4 is initiated and enabled when the first or second enable signal EN1 or EN2 becomes high. Specifically, the selectors 1255_1 and 1255_4 of the first and second dividers 1250_1 and 1250_4 selectively output logic level "1" in response to the first and second enable signals EN1 and EN2 at a high level, respectively, and selectively output outputs of the inverters 1253_1 and 1253_4 in response to the first and second enable signals EN1 and EN2 is at a low level, respectively.

Thus, the first divider 1250_1 may be initiated and enabled when the first enable signal EN1 becomes high (e.g., at a first period of a slave clock signal SPCLK). As the first enable signal EN1 becomes high, the first divider 1250_1 may divide the second sampling clock signal PCLK_0 and provide the first slave clock signal SPCLK_1. On the other hand, the second divider 1250_4 may be initiated and enabled when the second enable signal EN2 becomes high (e.g., at a second period of the slave clock signal SPCLK). As the second enable signal EN2 becomes high, the second divider 1250_4 may divide the second sampling clock signal PCLK_0 and provide the second slave clock signal SPCLK_4. That is, even when the first and second dividers 1250_1 and 1250_4 receive and halve the same second sampling clock signal PCLK_0, they may provide the first and second slave clock signals SPCLK_1 and SPCLK_4 having different phases, respectively.

Unlike the second sampling clock signals PCLK_0, PCLK_4 and PCLK_8, the first and second slave clock signals SPCLK_1 through SPCLK_6 output from the dividing unit 1250 may have substantially the same duty ratio. In addition, frequencies of the first and second slave clock signals SPCLK_1 through SPCLK_6 output from the dividing unit 1250 may be less than those of the first sampling clock signals PCLK_1, PCLK_3, PCLK_5, PCLK_7, PCLK_9, and PCLK_11.

That is, the master data driver 1001_1 of the exemplary embodiment of a display device can provide the slave clock signals SPCLK_1 through SPCLK_6 whose frequencies are lower than those of the first sampling clock signals PCLK_1, PCLK_3, PCLK_5, PCLK_7, PCLK_9, and PCLK_11, which are used to generate the slave image signal DAS_1', without including a separate PLL or DLL circuit. Therefore, the master data driver 1001_1 according to the present embodiment consumes less power and can be reduced in size as compared with a data driver which does include separate PLL or DLL circuits.

The slave image signal transmitter unit 1160 generates the slave image signal DAS_1' corresponding to the second data information using the slave clock signals SPCLK_1 through SPCLK_6 and includes the encoder 1161 and the slave image signal generator 1165.

The encoder 1161 receives the second data signal DATA_2 from the selection unit 1140 and encodes the second data signal DATA_2 into the second data information, which corresponds to the second data signal DATA_2, as shown in Table 1 above. In one exemplary embodiment, the slave image signal generator 1165 may convert the second data information received from the encoder 1161 into the slave image signal DAS_1', which corresponds to the second data information, using the slave clock signals SPCLK_1 through SPCLK_6 and output the slave image signal DAS_1'.

Generating the slave image signal DAS_1' using the slave image signal output unit 1160 will now be described in more detail with reference to FIGS. 11A and 11B.

Figure 11A:
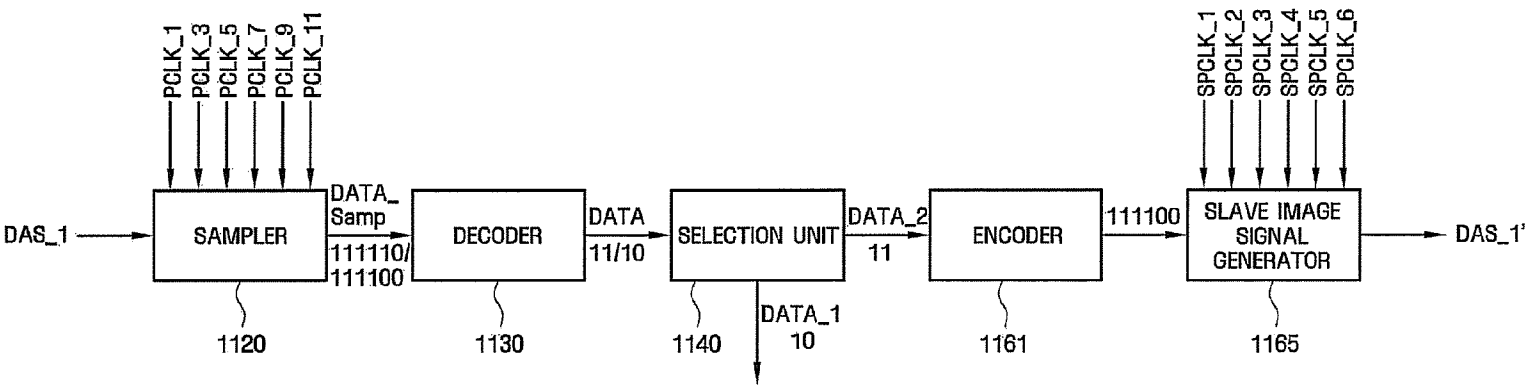
FIGS. 11A and 11B are diagrams illustrating an exemplary embodiment of a slave image signal output unit shown in FIG. 4.
Figure 11B:
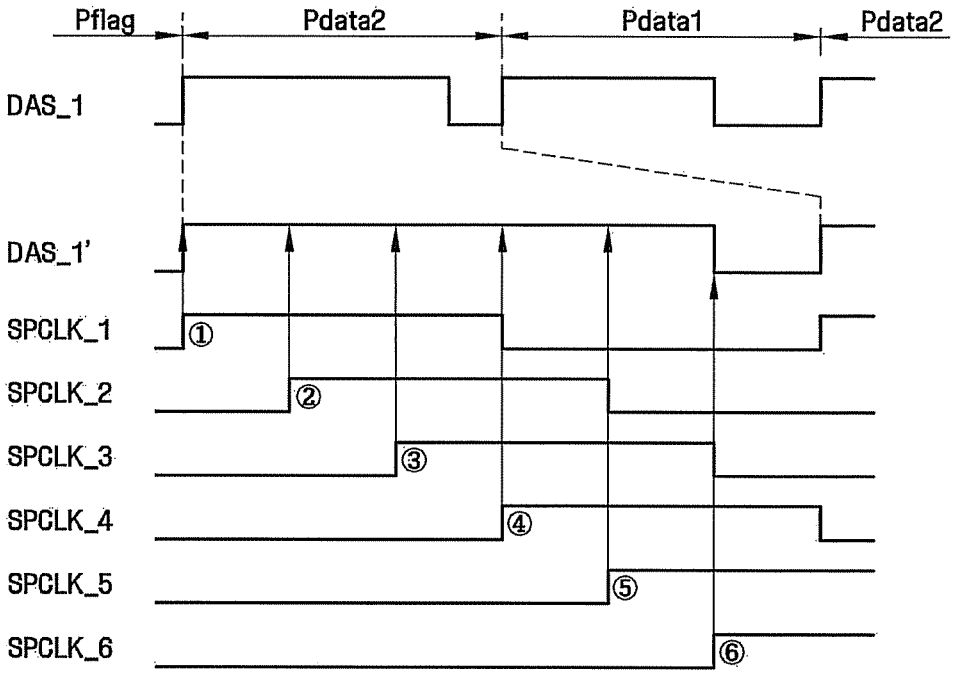

FIGS. 11A and 11B are diagrams illustrating an exemplary embodiment of the slave image signal output unit 1160 shown in FIG. 4.

Referring to FIGS. 11A and 11B, the encoder 1161 may receive the second data signal DATA_2 (e.g., "11"), which corresponds to a data voltage provided by the slave data driver 1002_1, from the selection unit 1140 and encode the second data signal DATA_2 into the second data information (e.g., "111110") as shown in Table 1. The slave image signal generator 1165 may generate the slave image signal DAS_1', which corresponds to the second data information, by using the slave clock signals SPCLK_1 through SPCLK_6 and provide the slave image signal DAS_1' to the slave data driver 1002_1. Here, since the slave clock signals SPCLK_1 through SPCLK_6 may have frequencies half as large as those of the second sampling clock signals PCLK_b, the slave image signal DAS_1' may have a period twice as long as that of the master image signal DAS_1.

Referring back to FIG. 1, the slave data drivers 1002_1 through 1002_*p* are respectively connected to the master data drivers 1001_1 through 1001_*p* in a cascade manner and provide data voltages corresponding to the second data information. Specifically, the slave data drivers 1002_1 through 1002_*p* may receive slave image signals DAS_1' through DAS_p' from the master data drivers 1001_1 through 1001_*p*, respectively, sample the second data information, and decode the second data signal DATA_2 which corresponds to the second data information. Then, the slave data drivers 1002_1 through 1002_*p* may provide data voltages, which correspond to the decoded second data signal DATA_2, to the data lines D1 through Dm.

In one exemplary embodiment, the slave data drivers 1002_1 through 1002_*p* may be configured in substantially the same way as the master data drivers 1001_1 through 1001_*p*. However, unlike the master data drivers 1001_1 through 1001_*p*, the selection unit 1140 and/or the slave image signal output unit 1160 of each of the slave data drivers 1002_1 through 1002_*p*, as well as the slave clock generator, may be disabled or omitted. That is, alternative exemplary embodiments of each of the slave data drivers 1002_1 through 1002_*p* may not include the selection unit 1140 and/or the slave image signal output unit 1160.

In the present exemplary embodiment of a display device, the signal controller 500 is connected to the master data drivers 1001_1 through 1001_*p* in a point-to-point manner, and the master data drivers 1001_1 through 1001_*p* are respectively connected to the slave data drivers 1002_1 through 1002_*p* in a cascade manner. Thus, unused bandwidth can substantially be reduced. In addition, not all data drivers (e.g., the master data drivers 1001_1 through 1001_*p* and the slave data drivers 1002_1 through 1002_*p*) are connected to the signal controller 500. Instead, only the master data drivers 1001_1 through 1001_*p* are connected to the signal controller 500. Thus, signal lines required to connect the data driver 1000 to the signal controller 500 can be reduced.

Figure 12A:
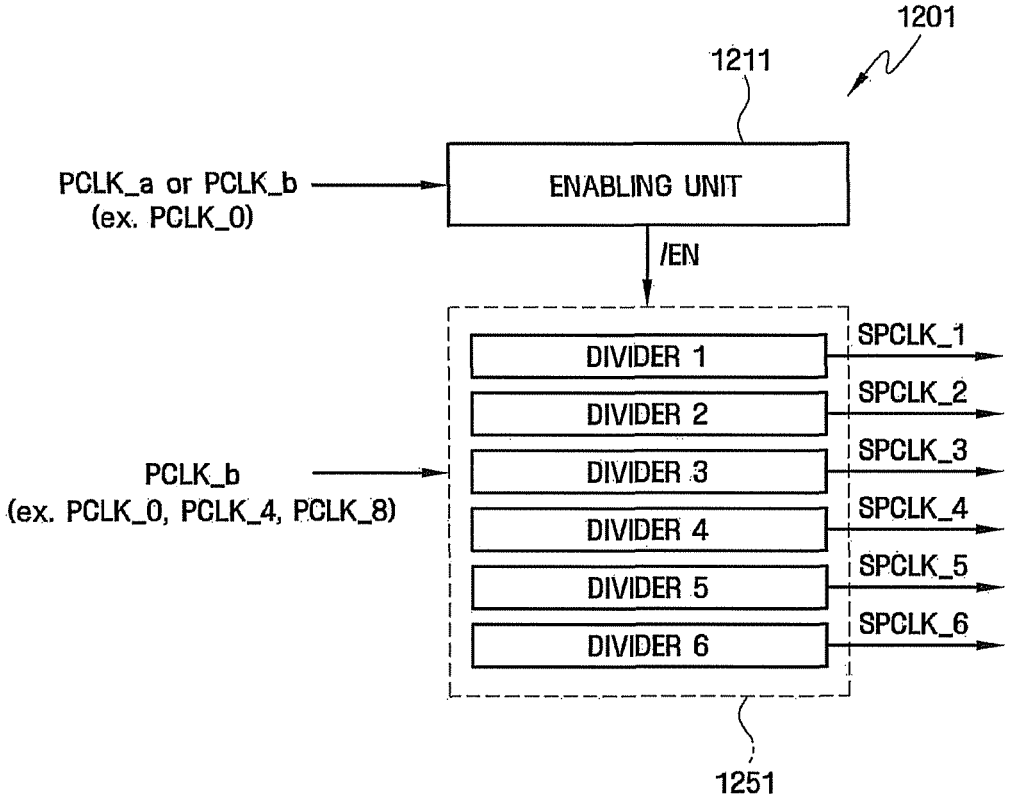
FIG. 12A is a block diagram of another exemplary embodiment of a slave clock generator of another exemplary embodiment of a master data driver according to the present invention.
Figure 12B:
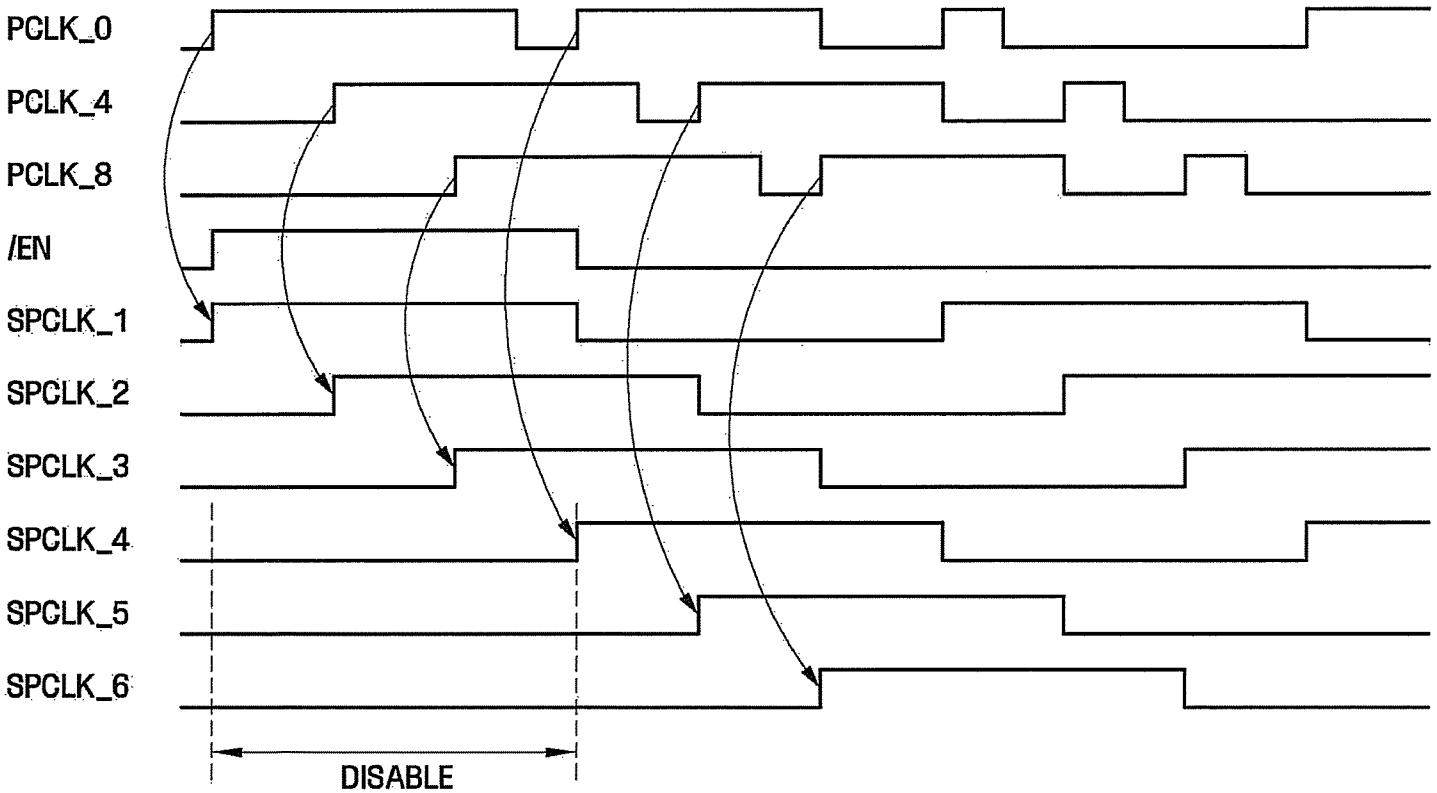
FIG. 12B is a timing diagram illustrating an exemplary embodiment of the operation of the exemplary embodiment of a slave clock generator shown in FIG. 12A.

FIG. 12A is a block diagram of another exemplary embodiment of a slave clock generator 1201 of a master data driver according to the present invention. FIG. 12B is a timing diagram illustrating the operation of the slave clock generator 1201 shown in 12A.

Referring to FIGS. 12A and 12B, the current exemplary embodiment of a slave clock generator 1201 may be substantially similar to the previous exemplary embodiment of a slave clock generator 1200, except that a plurality of dividers 1251_1 through 1251_6 included in a dividing unit 1251 of the slave clock generator 1201 are selectively disabled by an enable signal /EN.

Specifically, an enabling unit 1211 generates the enable signal /EN using a second sampling clock signal PCLK_0 and selectively provides the enable signal /EN to the first dividers 1251_1 through 1251_3 or the second dividers 1251_4 through 1251_6 included in the dividing unit 1251 to selectively disable the first dividers 1251_1 through 1251_3 or the second dividers 1251_4 through 1251_6. That is, the enabling unit 1211 may control times when the first dividers 1251_1 through 1251_3 and the second dividers 1251_4 through 1251_6 are enabled by the enable signal /EN.

In one exemplary embodiment, the enabling unit 1211 may selectively provide the enable signal /EN to the second dividers 1251_4 through 1251_6. Referring to FIG. 12B, while the first dividers 1251_1 through 1251_3 are enabled during a first period (or at a first rising edge time) of the second sampling clock signal PCLK_0, the second dividers 1251_4 through 1251_6 may be selectively disabled. Thus, even when the first and second dividers, e.g. 1251_1 and 1251_4 receive and halve the second sampling clock signal PCLK_0, they may provide first and second slave clock signals e.g. SPCLK_1 and SPCLK_4 having different phases, respectively, in response to the enable signal /EN.

In one exemplary embodiment, the enabling unit 1211 may be implemented as a circuit which does not include the second flip-flop 1217 in the circuit of FIG. 8A. However, the present invention is not limited thereto. The enabling unit 1211 may be configured in various circuit forms as long as it performs the same operation.

Figure 13:
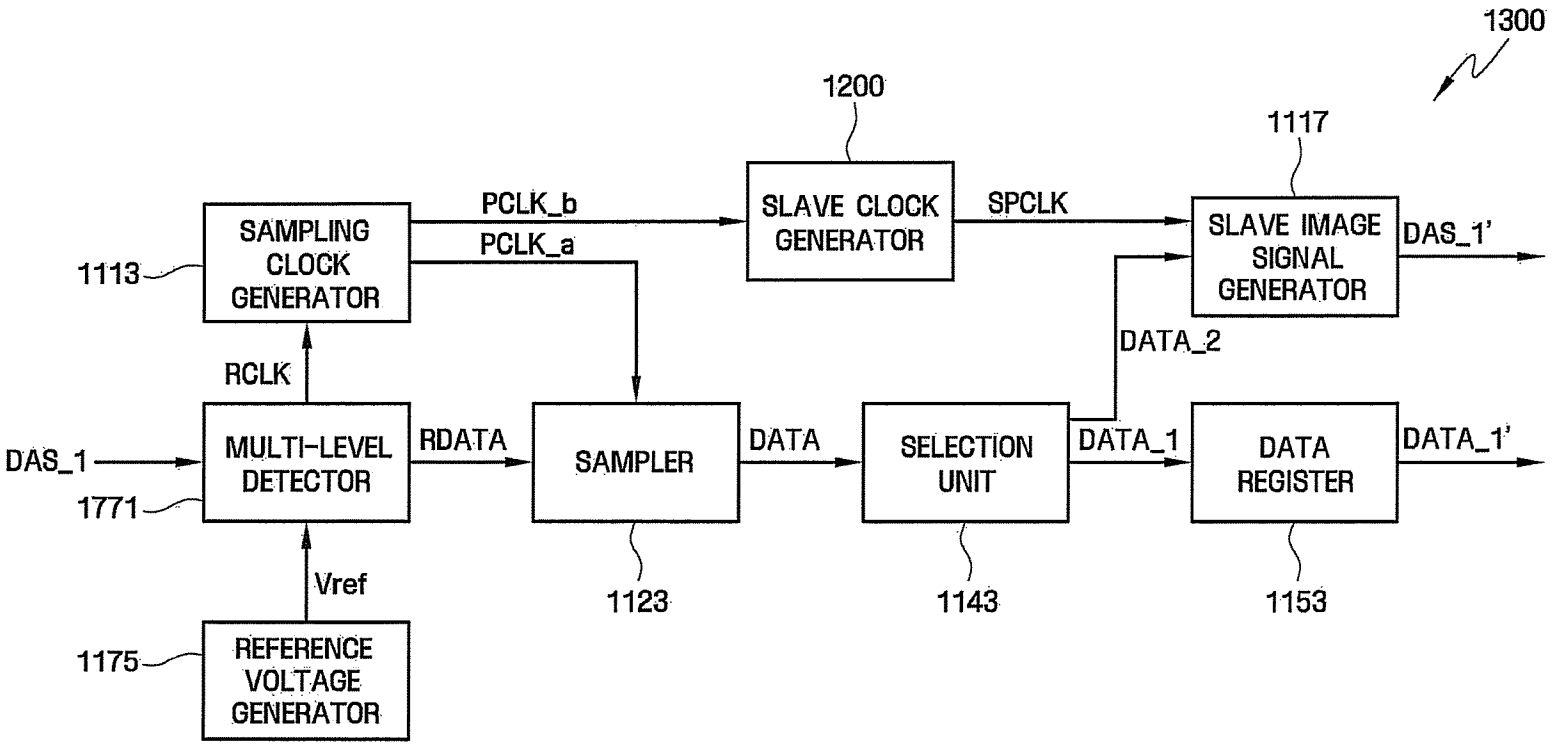
FIG. 13 is a block diagram of an exemplary embodiment of a transceiver of another exemplary embodiment of a master data driver according to the present invention.
Figure 14A:
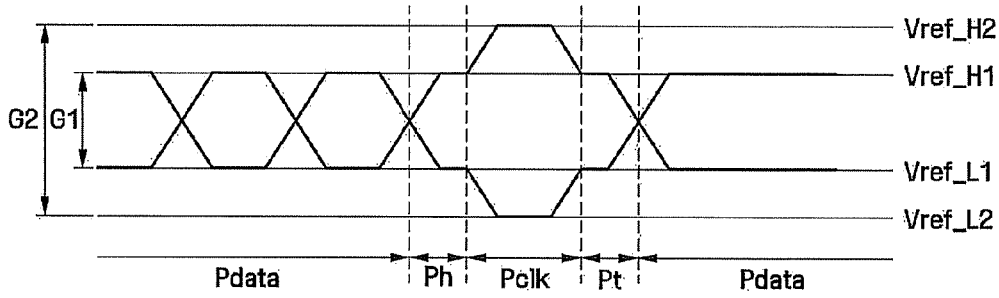
FIGS. 14A and 14B are diagrams illustrating an exemplary embodiment of a master image signal shown in FIG. 13.
Figure 14B:
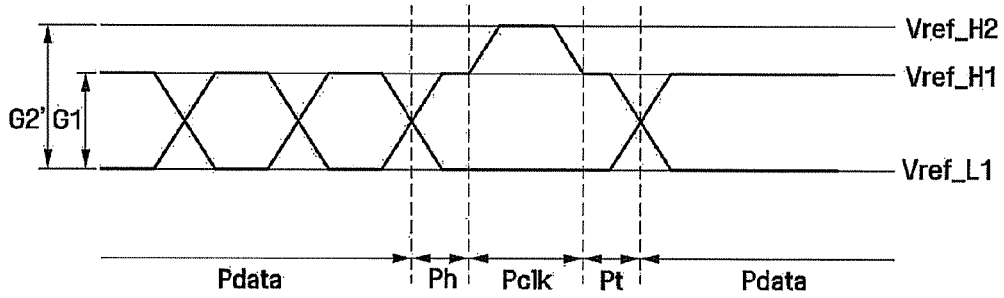

FIG. 13 is a block diagram of a transceiver 1113 of another exemplary embodiment of a master data driver according to the present invention. FIGS. 14A and 14B are diagrams illustrating a master image signal DAS_1 shown in FIG. 13.

Referring to FIGS. 13 through 14B, like the transceiver 1100 of the master data driver 1001_1 according to the embodiment of FIG. 4, the transceiver 1113 of the present exemplary embodiment of a master data driver may sample first and second data information from the master image signal DAS_1 using first sampling clock signals PCLK_a and generate a slave image signal DAS_1', which corresponds to the second data information, using second sampling clock signals PCLK_b having substantially the same frequency as the first sampling clock signals PCLK_a. In the present exemplary embodiment, the generating of the slave image signal DAS_1' using the second sampling clock signal PCLK_b, which is performed by the master data driver, may include generating slave clock signals SPCLK by dividing the second sampling clock signals PCLK_b and generating a slave image signal DAS_1', which corresponds to the second data information, using the slave clock signals SPCLK.

Unlike the master image signal DAS_1 according to the previous exemplary embodiments, the master image signal DAS_1 provided to the present exemplary embodiment of a master data driver may be a differential pair signal which includes first and second signals. The master image signal DAS_1 may have different levels in a data section Pdata which includes the first and second data information and a clock section Pclk which includes predetermined clock information used by the master data driver to sample the first and second data information. In one exemplary embodiment, referring to FIGS. 14A and 14B, the first and second signals of the master image signal DAS_1 swing between Vref_H1 and Vref_L1 in the data section Pdata while swinging between Vref_H2 and Vref_L2 (or Vref_L1) in the clock section Pclk. That is, an absolute value G1 of a level difference between the first and second signals of the master image signal DAS_1 in the data section Pdata may be different from an absolute value G2 or G2' of the level difference of the first and second signals in the clock signal Pclk. Here, a clock head section Ph or a clock tail section Pt may be interposed between the clock section Pclk and the data section Pdata, so that the master image signal DAS_1 can be provided while being substantially immune to electromagnetic interference ("EMI"). However, the present invention is not limited thereto. In other exemplary embodiments of a display device according to the present invention, the master image signal DAS_1 may selectively include the clock head section Ph or the clock tail section Pt, and the first and second signals may have different swing levels in the data section Pdata and the clock section Pclk.

In the present exemplary embodiment, the transceiver 1113 of the master data driver 1001_1, which operates in response to the master image signal DAS_1, may include a multi-level detector 1771, a reference voltage generator 1175, a sampling clock generator 1111, a sampler 1121, a selection unit 1143, a data register 1153, a slave clock generator 1200, and a slave image signal generator 1117. Since the selection unit 1143, the data register 1153, and the slave clock generator 1200 are substantially identical to those according to the exemplary embodiment of FIG. 4, a detailed description thereof will be omitted.

The multi-level detector 1771 receives the master image signal DAS_1, which is a differential pair signal as described above, and divides the master image signal DAS_1 into the first and second data information and the clock information using a reference voltage Vref which is provided by the reference voltage generator 1175. Specifically, the multi-level detector 1771 may detect the first and second data information based on an absolute value of the level difference between the first and second signals and provide the first and second data information to the sampler 1123. In addition, the multi-level detector 1771 may detect the clock information and provide the clock information to the sampling clock generator 1111.

The reference voltage Vref provided to the multi-level detector 1771 may vary according the voltage levels of the first and second signals as they swing between voltages. Referring to FIG. 14A, the first and second signals may swing between Vref_H1 and Vref_L1 in the data section Pdata and between Vref_H2 and Vref_L2 in the clock section Pclk. In such an exemplary embodiment, the reference voltage generator 1175 may provide four different voltage levels (Vref_H1, Vref_H2, Vref_L1, and Vref_L2) to the multi-level detector 1771. In addition, referring to FIG. 14B, the first and second signals may swing between Vref_H1 and Vref_L1 in the data section Pdata and between Vref_H2 and Vref_L1 in the clock section Pclk. In such an exemplary embodiment, the reference voltage generator 1175 may provide three different voltage levels (Vref_H1, Vref_H2, and Vref_L1) to the multi-level detector 1771.

The slave image signal generator 1117 receives a second data signal DATA_2 and provides the slave image signal DAS_1', which corresponds to the second data information, using the slave clock signals SPCLK. Specifically, the slave image signal generator 1117 inserts clock signals with different levels between the second data signal DATA_2 using the slave clock signals SPCLK and generates the slave image signal DAS_1' as shown in FIGS. 14A and 14B.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A display device comprising:

a signal controller which outputs a master image signal having first data information and second data information;

a master data driver which receives the master image signal and generates a slave image signal; and a slave data driver connected to the master data driver in a cascade manner, wherein the slave image signal corresponds to the second data information, wherein the master data driver comprises:

a sampling clock generator which generates a first sampling clock signal and a second sampling clock signal using the master image signal; and a slave clock generator which generates a slave clock signal using the second sampling clock signal, and wherein the slave clock generator comprises:

an enabling unit which generates an enable signal using at least one of the first sampling clock signal and the second sampling clock signal; and a dividing unit which divides the second sampling clock signal in response to the enable signal and outputs the slave clock signal.

2. The display device of claim 1, wherein the slave clock signal comprises a first slave clock signal and a second slave clock signal, and the dividing unit comprises a first divider which outputs the first slave clock signal using the second sampling clock signal and a second divider which outputs the second slave clock signal using the second sampling clock signal, wherein the first divider and second divider are enabled at different times in response to the enable signal and output the first slave clock signal and the second slave clock signal, respectively.

3. The display device of claim 2, wherein when a period of time between rising edges, at each of which the second sampling clock signal transits from a low level to a high level, is defined as a period of the second sampling clock signal and when the first divider outputs the first slave clock signal by dividing the second sampling clock signal and the second divider outputs the second slave clock signal by dividing the second sampling clock signal, the second divider is enabled after a period of time corresponding to the period of the second sampling clock signal, after the first divider is enabled.

4. The display device of claim 1, wherein the master data driver is connected to the signal controller in a point-to-point manner.

5. The display device of claim 1, wherein the master data driver further comprises:

a sampler which samples the first data information and the second data information from the master image signal using the first sampling clock signal; and a slave image signal generator which generates the slave image signal, which corresponds to the second data information, using the slave clock signal.

6. The display device of claim 5, wherein the master data driver further comprises:

a decoder which decodes a first data signal and a second data signal corresponding to the first data information and the second data information, respectively;

a selection unit which receives the first and second data signals decoded by the decoder and which selectively outputs at least one of the first data signal and the second data signal; and an encoder which receives the second data signal, encodes the second data signal into the second data information, and outputs the second data information to the slave image signal generator.

7. The display device of claim 1, wherein the master image signal comprises a first data section which contains the first data information and a second data section which contains the second data information, and the first data information and the second data information are determined by duty ratios of the master image signal in the first data section and the second data section, respectively.

8. The display device of claim 7, wherein when the master image signal is divided into unit signals by period, there is a substantially constant time interval between respective rising edges of the unit signals, and there is a variable time interval between respective falling edges of the unit signals, wherein each unit signal transits from a low level to a high level at a rising edge thereof and transits from a high level to a low level at a falling edge thereof.

9. The display device of claim 7, wherein the first data section and the second data section of the master image signal are alternately arranged.

10. The display device of claim 1, wherein the image signals, the first sampling clock signal and the second sampling clock signal have variable duty ratios, and the slave clock signal has a substantially constant duty ratio.

11. A data driving apparatus comprising:

a sampling clock generator which generates a first sampling clock signal and a second sampling clock signal having substantially the same frequency as the first sampling clock signal using a master image signal which comprises first data information and second data information;

a sampler which samples the first data information and the second data information using the first sampling clock signal;

a slave clock generator which generates a slave clock signal using the second sampling clock signal;

a slave image signal generator which generates a slave image signal which corresponds to the second data information using the slave clock signal; and a data voltage generator which generates a data voltage corresponding to the first data information, wherein the slave clock generator comprises:

an enabling unit which generates an enable signal using at least one of the first sampling clock signal and the second sampling clock signal; and a dividing unit which divides the second sampling clock signal in response to the enable signal and outputs the slave clock signal.

12. The driving apparatus of claim 11, wherein the slave clock signal comprises a first slave clock signal and a second slave clock signal, and the dividing unit comprises a first divider which outputs the first slave clock signal using the second sampling clock signal and a second divider which outputs the second slave clock signal using the second sampling clock signal, wherein the first divider and the second divider are enabled at different times in response to the enable signal and output the first slave clock signal and the second slave clock signal, respectively.

13. The driving apparatus of claim 12, wherein when a period of time between rising edges, at each of which the second sampling clock signal transits from a low level to a high level, is defined as a period of the second sampling clock signal and when the first divider outputs the first slave clock signal by dividing the second sampling clock signal and the second divider outputs the second slave clock signal by dividing the second sampling clock signal, the second divider is enabled after a period of time corresponding to the period of the second sampling clock signal, after the first divider is enabled.

14. The driving apparatus of claim 11, further comprising:

a decoder which decodes a first data signal and a second data signal corresponding to the first data information and the second data information, respectively;

a selection unit which receives the first and second data signals decoded by the decoder and which selectively outputs at least one of the first data signal and the second data signal;

an encoder which receives the second data signal, encodes the second data signal into the second data information, and outputs the second data information to the slave image signal generator; and a data voltage generator which generates a data voltage corresponding to the first data information.

15. The driving apparatus of claim 11, wherein the master image signal comprises:

a first data section which contains the first data information; and a second data section which contains the second data information, wherein the first data information and the second data information are determined by duty ratios of the master image signal in the first data section and the second data section, respectively.

16. The driving apparatus of claim 15, wherein when the master image signal is divided into unit signals by period, there is a substantially constant time interval between respective rising edges of the unit signals, and there is a variable time interval between respective falling edges of the unit signals, wherein each unit signal transits from a low level to a high level at a rising edge thereof and transits from a high level to a low level at a falling edge thereof.

17. The driving apparatus of claim 15, wherein the first data section and the second data section of the master image signal are alternately arranged.

18. A display device comprising:

a signal controller which outputs a master image signal having first data information and second data information;

a master data driver which receives the master image signal and generates a slave image signal; and a slave data driver connected to the master data driver in a cascade manner, wherein the slave image signal corresponds to the second data information, wherein the master data driver comprises:

a sampling clock generator which generates a first sampling clock signal and a second sampling clock signal using the master image signal; and a slave clock generator which generates a slave clock signal using the second sampling clock signal, and wherein the slave clock generator comprises an enabling unit which generates an enable signal using at least one of the first sampling clock signal and the second sampling clock signal; and a dividing unit which divides the second sampling clock signal in response to the enable signal and outputs the slave clock signal, and wherein the slave clock signal comprises a first slave clock signal and a second slave clock signal, and the dividing unit comprises a first divider which outputs the first slave clock signal using the second sampling clock signal and a second divider which outputs the second slave clock signal using the second sampling clock signal, wherein the first divider and second divider are enabled at different times in response to the enable signal and output the first slave clock signal and the second slave clock signal, respectively.

19. A display device comprising:

a signal controller which outputs a master image signal having first data information and second data information;

a master data driver which receives the master image signal and generates a slave image signal; and a slave data driver connected to the master data driver in a cascade manner, wherein the slave image signal corresponds to the second data information, wherein the master image signal comprises a first data section which contains the first data information and a second data section which contains the second data information, and the first data information and the second data information are determined by duty ratios of the master image signal in the first data section and the second data section, respectively, and wherein when the master image signal is divided into unit signals by period, there is a substantially constant time interval between respective rising edges of the unit signals, and there is a variable time interval between respective falling edges of the unit signals, wherein each unit signal transits from a low level to a high level at a rising edge thereof and transits from a high level to a low level at a falling edge thereof.

20. A display device comprising:

a signal controller which outputs a master image signal having first data information and second data information;

a master data driver which receives the master image signal and generates a slave image signal; and a slave data driver connected to the master data driver in a cascade manner, wherein the slave image signal corresponds to the second data information, wherein the master data driver comprises:

a sampling clock generator which generates a first sampling clock signal and a second sampling clock signal using the master image signal; and a slave clock generator which generates a slave clock signal using the second sampling clock signal, and wherein the image signals, the first sampling clock signal and the second sampling clock signal have variable duty ratios, and the slave clock signal has a substantially constant duty ratio.

21. A display device comprising:

a signal controller which outputs a master image signal having first data information and second data information;

a master data driver which receives the master image signal and generates a slave image signal; and a slave data driver connected to the master data driver in a cascade manner, wherein the slave image signal corresponds to the second data information, wherein the master data driver comprises:

a sampling clock generator which generates a first sampling clock signal and a second sampling clock signal using the master image signal;

a slave clock generator which generates a slave clock signal using the second sampling clock signal;

a sampler which samples the first data information and the second data information from the master image signal using the first sampling clock signal;

a slave image signal generator which generates the slave image signal, which corresponds to the second data information, using the slave clock signal;

a decoder which decodes a first data signal and a second data signal corresponding to the first data information and the second data information, respectively;

a selection unit which receives the first and second data signals decoded by the decoder and which selectively outputs at least one of the first data signal and the second data signal; and an encoder which receives the second data signal, encodes the second data signal into the second data information, and outputs the second data information to the slave image signal generator.

22. A data driving apparatus comprising:

a sampling clock generator which generates a first sampling clock signal and a second sampling clock signal having substantially the same frequency as the first sampling clock signal using a master image signal which comprises first data information and second data information;

a sampler which samples the first data information and the second data information using the first sampling clock signal;

a slave clock generator which generates a slave clock signal using the second sampling clock signal;

a slave image signal generator which generates a slave image signal which corresponds to the second data information using the slave clock signal;

a data voltage generator which generates a data voltage corresponding to the first data information;

a decoder which decodes a first data signal and a second data signal corresponding to the first data information and the second data information, respectively;

a selection unit which receives the first and second data signals decoded by the decoder and which selectively outputs at least one of the first data signal and the second data signal;

an encoder which receives the second data signal, encodes the second data signal into the second data information, and outputs the second data information to the slave image signal generator; and a data voltage generator which generates a data voltage corresponding to the first data information.

23. A data driving apparatus comprising:

a sampling clock generator which generates a first sampling clock signal and a second sampling clock signal having substantially the same frequency as the first sampling clock signal using a master image signal which comprises first data information and second data information;

a sampler which samples the first data information and the second data information using the first sampling clock signal;

a slave clock generator which generates a slave clock signal using the second sampling clock signal;

a slave image signal generator which generates a slave image signal which corresponds to the second data information using the slave clock signal; and a data voltage generator which generates a data voltage corresponding to the first data information, wherein the master image signal comprises:

a first data section which contains the first data information; and a second data section which contains the second data information, wherein the first data information and the second data information are determined by duty ratios of the master image signal in the first data section and the second data section, respectively, and wherein when the master image signal is divided into unit signals by period, there is a substantially constant time interval between respective rising edges of the unit signals, and there is a variable time interval between respective falling edges of the unit signals, wherein each unit signal transits from a low level to a high level at a rising edge thereof and transits from a high level to a low level at a falling edge thereof.

* * * * *